United States Patent [19]

Charpentier

[11] 4,342,975

[45] Aug. 3, 1982

[54] MAGNETIC RETURN CONTROL KEY

[76] Inventor: Roger Charpentier, Bosquet Ay'mi, Avenue Beau Soleil, 64320 Idron, France

[21] Appl. No.: 199,865

[22] Filed: Oct. 23, 1980

[30] Foreign Application Priority Data

Oct. 31, 1979 [FR] France ..... 79 27077

[51] Int. Cl.[3] ..... H01H 13/22; H01H 3/12

[52] U.S. Cl. ..... 335/205

[58] Field of Search ..... 335/205, 206, 207; 200/73, 74, 159 R, 159 A, 67 F, 328; 338/32

[56] References Cited

U.S. PATENT DOCUMENTS 3,072,769 1/1963 Roeser ..... 200/160
3,906,417 9/1975 Serras-Paulet ..... 335/205
3,934,215 1/1976 Rich et al. ..... 335/207

FOREIGN PATENT DOCUMENTS 1219111 6/1966 Fed. Rep. of Germany .
2522870 10/1980 Fed. Rep. of Germany .

*Primary Examiner*—L. T. Hix
*Assistant Examiner*—S. D. Schneyer

[57] ABSTRACT

The invention relates to a control key, consisting of a fixed casing, a push-button mounted for sliding in the casing and magnetic means for returning the push-button to its rest position. The casing comprises a hollow center part opened towards the top and of which the bottom is at least partly closed off by a wall of predetermined thickness, to form a housing for a permanent magnet. The said push-button is hollow on the inside so as to cap the said center part, and is provided at its lower end with a plate of magnetic material, closing off the hollow inside of the push-button beyond the said wall.

The invention finds an application in keyboard installations.

5 Claims, 3 Drawing Figures

MAGNETIC RETURN CONTROL KEY

BACKGROUND OF THE INVENTION

The invention relates to a control key of the type comprising a digital-actuated push-button, adapted to move with respect to a fixed support between a rest position and a work position in which, for example, it actuates the movable element of an electrical switch to close it. Generally, this type of keys comprises a return member for returning the push-button to its rest position.

Said return member can be, in known manner, of the spring type. One of the disadvantages of this spring type return is due to the characteristic of the spring. For example, for a given stroke of the push-button, the return force of said button which is opposed to the pressing-in increases with the stroke. The pressing-in force must therefore always be greater than the maximum return force, i.e. than the force opposed by the spring at end-of-stroke of the push-button, in order to ensure that the said push-button has reached its work position. It can happen that the pressure exerted on the push-button is too small but yet causes a displacement of the latter without this displacement being sufficient to have reached the work position. Then, the expected result is not obtained although the operator had the feeling to have correctly manoeuvred the key. Moreover, such a device which is designed to be actuated repeatedly has its characteristics altering with time, wear, and ageing of the spring, etc.

To overcome such disadvantages, magnetic return keys have been proposed. The advantage of the magnetic return force is that it is of maximum intensity when the air gap is minimum. Thus, to move the movable part away from the fixed part, it is necessary from the start to overcome said maximum force which thereafter decreases very rapidly. Then, once the key is pressed-in, it is a certainty that the actuating force will be sufficient to make the said key reach its work position. The actuation of such a key is therefore much more reliable, since when pressing the finger on the key the operator is sure of reaching the work position. Moreover, said magnetic return means suffer virtually no deterioration with time.

But, although the principle of the magnetic return is an advantageous solution with this type of device, its production raises a number of problems. One of these problems is found in the characteristics proper of the magnetic return. Indeed, the resistance to the pressing-in of the key is imposed, this entailing that the maximum attractive force of the magnet with no air gap is dictated by that resistance. Moreover, the stroke of the key is also dictated by the technology of the controlled member and cannot be selected freely. Because of these strains, it is noted that the magnetic force for returning the key from its work position to its rest position is very small and cannot be sufficient to overcome the weight of the key increased with a few random forces of friction.

It is the object of the present invention to overcome this disadvantage by proposing a magnetic return control key fulfilling all the requirements of this type of product, using only means that are simple to produce and to assemble, and suitable for highly automated production.

SUMMARY OF THE INVENTION

To this end, the invention proposes a control key consisting of a fixed casing, a push-button mounted for sliding inside said casing between a first standing-out rest position and a second set-in work position, and magnetic means for returning the said push-button to its rest position, said means being constituted by a permanent magnet integral with the casing and by a plate of magnetic material integral with said push-button .

According to one special characteristic of the invention, the said casing comprises a hollow centre part opened towards the top, and of which the bottom is at least partly closed by a wall of predetermined thickness, said centre part forming a housing for the said permanent magnet, whereas the said push-button is hollow on the inside so as to cap in slidable manner the said centre part, the depth of the hollow being greater than the height of the said centre part, and supports on its lower part the said plate of magnetic material, said latter closing off the hollow inside of the push-button beyond the bottom wall of the said centre part thus imprisoned in said hollow inside.

According to a preferred embodiment, the said centre part is integral with a side enclosure comprised on the casing, and defines therewith a sliding space for the side walls of the push-button, by means of clips extending crosswise into said space whereas the said side walls of the push-button are cut in at right angle of said clips over a height which allows the sliding of the push-button with respect to the casing.

Advantageously, the inside shape of the said centre part is parallelepipedal, the said permanent magnet having then a parallelepipedal shape complementary thereto.

Furthermore, the said plate of magnetic material is in resting contact on the bottom wall of the said centre part, when the push-button is in the rest position and is provided on its external face with bosses for actuating electrical switches connected in known manner to the fixed part.

DESCRIPTION OF DRAWINGS

The invention will be more readily understood on reading the following description with reference to the accompanying drawings, in which.

DETAILED DESCRIPTION OF INVENTION

Figure 2:
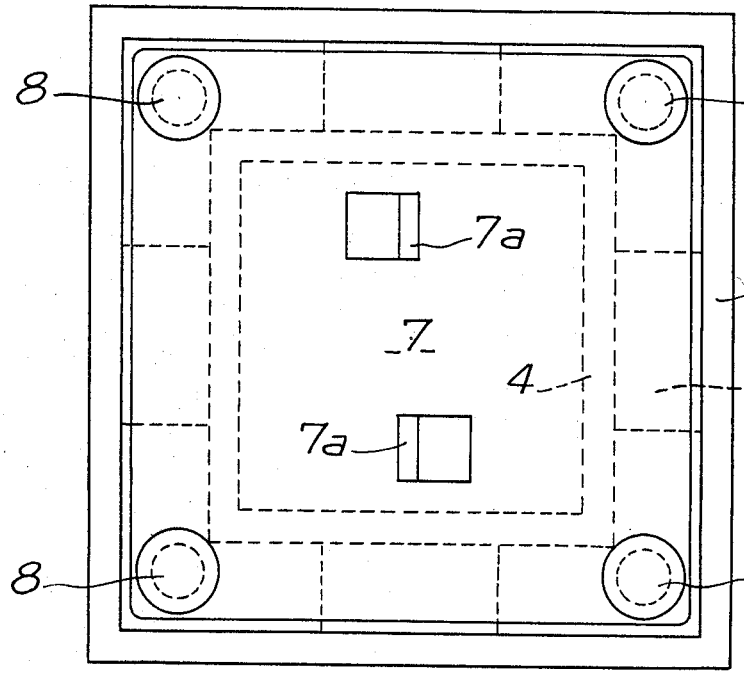
FIG. 2 is a view from underneath of the embodiment shown in FIG. 1.
Figure 1:
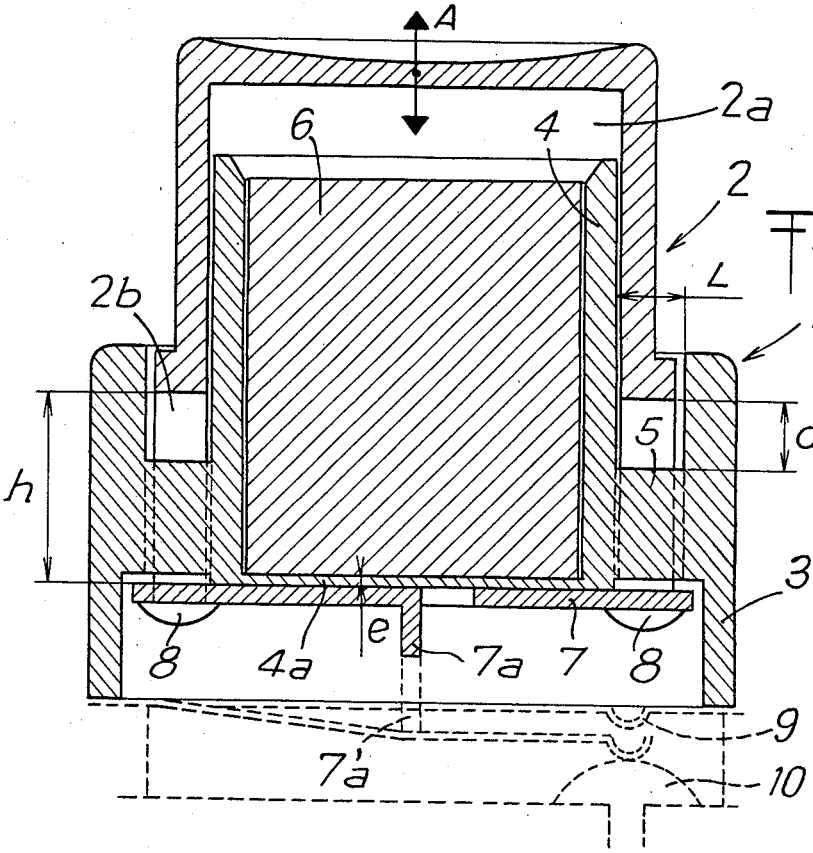
FIG. 1 is a cross-sectional view of a key according to the invention.

FIGS. 1 and 2 show that the key consists in a casing 1 and a push-button 2 adapted to slide in the direction A with respect to the casing. Said casing is in effect constituted by an outer enclosure 3 and an inner centre part 4 spaced apart from the enclosure 3. The centre part is integral with the side enclosure 3 via clips 5 which extend crosswise into the space L separating them. Said centre part 4 is hollow and opened at its upper end. Its lower end is closed off by a bottom 4*a* of predetermined thickness e. According to a variant not shown, said bottom need not be complete and may consist in an inner edge of the lower portion of the centre part 4. The recess thus defined in the part 4 is used for housing a permanent magnet 6. The shape of this recess will have to be complementary to that of the magnet so that said latter can easily be introduced therein through the top opening. Preferably, the shape will be paralellepipedal, because parallelepipedal-shaped permanent magnets are the most inexpensive to produce.

The push-button 2 is hollow on the inside so as to cap the said centre part 4. Its hollow inside 2*a* is complementary in shape to the outline of the centre part (i.e. cylindrical or parallelepipedal) said central part guiding the sliding of the push-button. The lower part of the side walls of the push-button 2 is provided with indentations 2*b* at right angles with the clips 5 connecting parts 3 and 4 of the casing. The height h of said indentations is such as to allow the desired sliding stroke of the push-button with respect to the casing. Finally, the push-button 2 is provided at its lower end with a plate 7 in magnetic material which closes off the hollow inside 2*a* beyond the wall 4*a* of the centre part, said latter being thus imprisoned inside the push-button. Said plate is fastened on the lower end of the push-button 2 by any known means and preferably by riveting an excess of material from the push-button to the external face of the plate. If said material is a plastic, the riveting (shown in the Figures in 8) may be done supersonically. The plate 7 is provided with bosses 7*a* (illustrated here as bent portions of the actual plate 7) oriented downwardly, i.e. its outer face, said projecting parts constituting control members for the movable parts 9 of an electrical switch known per se, situated at a predetermined distance of the casing 1. For example, FIG. 1 shows that by pressing-in the push-button 2 until it abuts with the top of part 4 or with the top of the clips 5 via the bottom of the indentations 2*b*, it is possible to move the bosses 7*a* to a position 7'*a* and to move the said part 9 so as to bring it into contact with the fixed part 10 therby closing off a circuit. By releasing the push-button, the magnet 6 attracts the plate 7 and thus raises the button until said plate 7 comes into abutment on the wall 4*a* of the bottom of the centre part 4.

Figure 3:
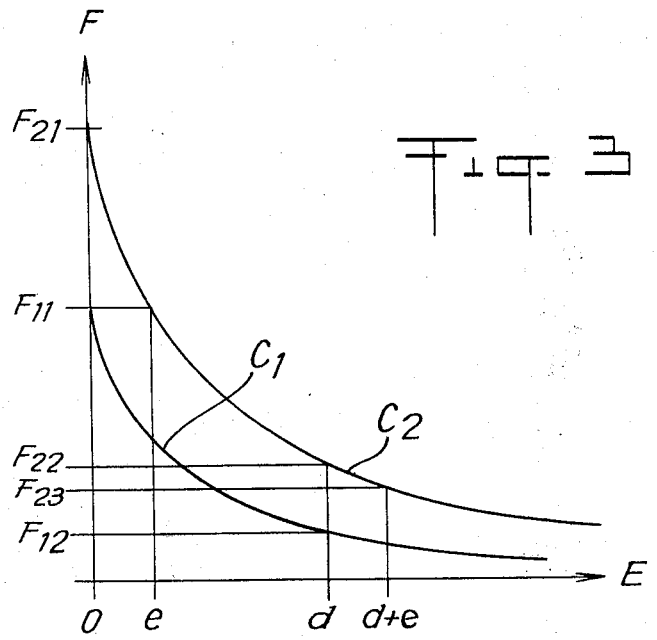
FIG. 3 is a significant diagram of the forces developed by the magnetic return members according to the invention.

FIG. 3 shows two curves C1 and C2 illustrating the variations of the attractive force of a permanent magnet in relation to the extent of the air gap. The curve C1 is that relative to a magnet with a maximum attractive force (i.e. with no air gap) F11 corresponding to the desired resistance to pressing-in which should be opposed by the push-button. It is clear that for an air gap d corresponding to the stroke of the push-button when the latter has reached its work position, the return force F12 is very small and insufficient to obtain a reliable return of the push-button, considering its weight and any friction forces exerted.

The choice of a stronger magnet of characteristic curve C2 permits to obtain a remote attraction F22 which is clearly stronger and might be satisfactory. On the contrary, the attraction with no air gap F21 is much too strong and the resistance to the pressing-in of the push-button too great. The solution to this problem proposed by the invention is to keep a minimum air gap of value e corresponding to the thickness of the bottom wall 4*a* of the part 4 of the casing. In this way, the resistance to pressing-in is brought back to its desired value F11. In this case, and considering the stroke d which has to be respected, the remote attractive force F23 which is obtained is a little less than that F22 mentioned hereinabove, but nonetheless remains stronger than the said F12. It is then obvious that the said thickness e controls the magnetic characteristics of the permanent magnet used.

A further advantage of the invention resides in the fact that the magnet is never in direct contact with the returned part. As a result, this magnet is not directly subjected to continuously repeated shocks, thus avoiding any risk of gradual disintegrating of the magnet which is generally made of fritted material.

Moreover, even though some particles of the magnet may become loose, these will be retained in the centre part of the casing, thereby avoiding the formation of undesirable particles between the magnet and the attracted magnetic plate which would alter the value of the minimum air gap.

It is also known that the remote attractive force of a magnet depends, for a given surface, of its thickness. The arrangements of the invention advantageously permit to use a magnet of relatively small cross-section, which is important if it is to be incorporated to a key of relatively small dimension, but of great thickness, and so with a relatively strong attractive power. The great thickness also permits a good guiding.

Finally, the design of the key according to the invention facilitates the automatic assembly of the different constitutive elements. It also permits to avoid having to use perforated magnets which are expensive. Also, the magnet being placed along the central axis of the key, there is no need to hold it in place with great accuracy, and for example by molding over it a plastic cage for hlding it in position, which would increase the production cost of the key.

Said key may be mounted by clipping into a support which is provided with a predetermined number of honeycomb cells to form a complete keyboard, whilst the movable elements of the electrical switches can be pre-mounted on each key casing or, on the contrary, can be integral with a support which can adapt to the constituted keyboard.

The invention finds an advantageous application in the computer industry, and in telecommunications or more generally in the production of keyboard control elements.

What is claimed is:

1. Control key constituted by a fixed casing, a push-button mounted for sliding inside said casing between a first standing-out rest position and a second set-in work position, and magnetic means for returning the said push-button to its rest position, said means being constituted by a permanent magnet integral with the casing and by a plate of magnetic material integral with said push-button, wherein the said casing comprises a hollow centre part opened towards the top, and of which the bottom is at least partly closed by a wall of predetermined thickness, said centre part forming a housing for the said permanent magnet, whereas the said push-button is hollow on the inside so as to cap in slidable manner the said centre part, the depth of the hollow being greater than the height of the said centre part, and supports on its lower part the said plate of magnetic material, said latter closing off the hollow inside of the push-button beyond the bottom wall of the said centre part thus imprisoned in said hollow inside.

2. The control key of claim 1, wherein the said centre part is integral with a side enclosure comprised on the casing, and defines therewith a sliding space for the side walls of the push-button, by means of clips extending crosswise into said space whereas the said side walls of the push-button are cut in at right angle of said clips ver a height which allows the sliding of the push-but-
on with respect to the casing.

3. The control key of claim 1, wherein the said centre
art is parallelepipedal on the inside, the said permanent
iagnet being of parallelepipedal shape to complement
ie inside shape of the centre part.

4. The control key of claim 1, wherein in the rest position, the plate of magnetic material is in resting contact on the bottom wall of the said centre part.

5. The control key of claim 1, wherein the plate of magnetic material is provided on its external face with bosses for actuating electrical switches cooperating with the fixed part of the casing.

* * * * *